United States Patent [19]

Shalit

[11] Patent Number: 4,893,435

[45] Date of Patent: Jan. 16, 1990

[54] LOW PROFILE SLIDING DOOR OPENER

[75] Inventor: H. Stanley Shalit, Seminole, Fla.

[73] Assignee: Remote-A-Matic, Inc., Bradenton, Fla.

[21] Appl. No.: 335,118

[22] Filed: Apr. 7, 1989

[51] Int. Cl.[4] ..... E05F 15/14

[52] U.S. Cl. ..... 49/360; 49/139; 49/280; 49/449

[58] Field of Search ..... 49/360, 139, 140, 280, 49/362, 449

[56] References Cited

U.S. PATENT DOCUMENTS

| | | | |
|---|---|---|---|
| 2,334,198 | 11/1943 | Ackley | 49/139 X |
| 3,403,474 | 10/1968 | Spasoff | 49/360 |
| 3,890,744 | 6/1975 | Galis | 49/360 |
| 4,330,960 | 5/1982 | Hasemann et al. | 49/360 X |
| 4,503,637 | 3/1985 | Parente | 49/360 X |
| 4,674,231 | 6/1987 | Radek et al. | 49/360 X |
| 4,738,052 | 4/1988 | Yoshida | 49/360 X |

*Primary Examiner*—Philip C. Kannan

*Attorney, Agent, or Firm*—Warren L. Franz

[57] ABSTRACT

An opener for a sliding panel closure of a wall opening has a toothed belt horizontally disposed between a toothed sprocket and an arcuate grooved shoe located within a threshold plate extending across the opening adjacent a channel strip within which the panel slides. A bracket attaches the panel to the belt which moves the panel between closed and open positions by a shaft coupled through an electrical clutch between the sprocket and a motor. A solenoid driven armature raises and lowers a pin relative to the sprocket teeth to lock panel movement. A handle and latch provides override to unlock the panel for manual operation. The motor, clutch, solenoid and all other electrical components are separately housed marginally of the opening, at a location above the threshold to protect them from water.

20 Claims, 3 Drawing Sheets

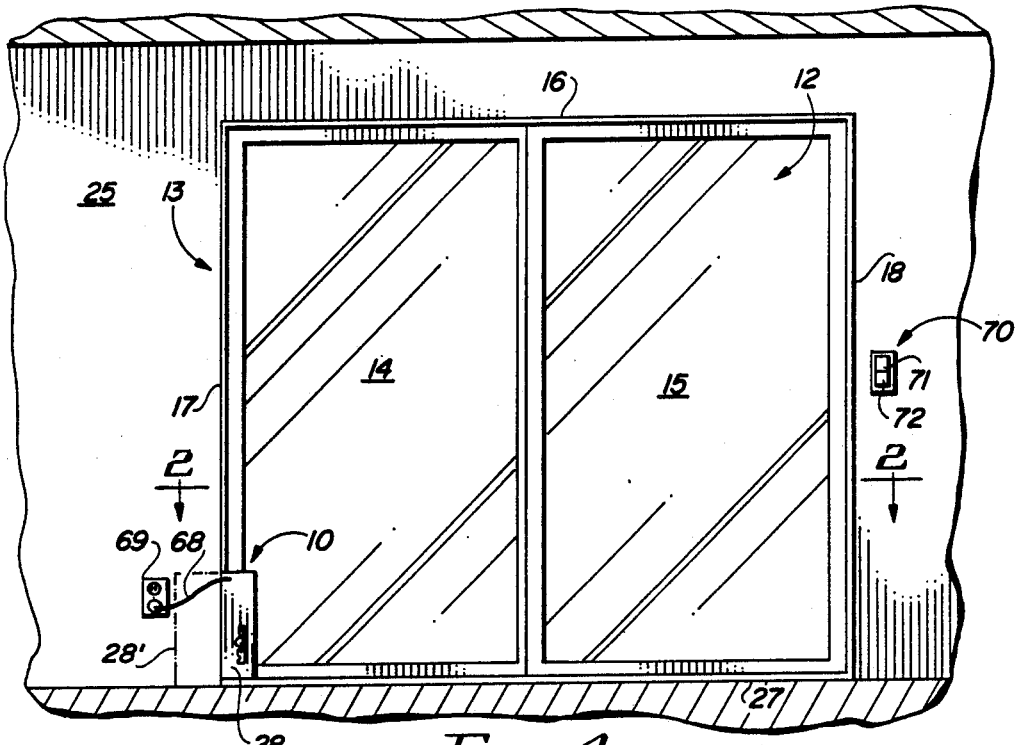
FIG. 1
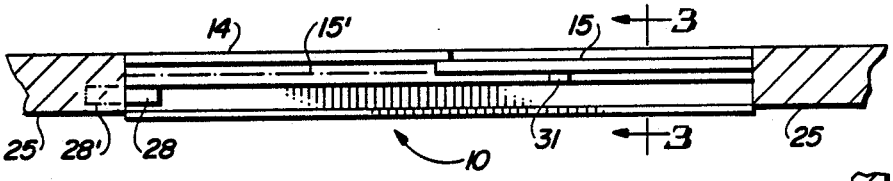
FIG. 2
FIG. 3
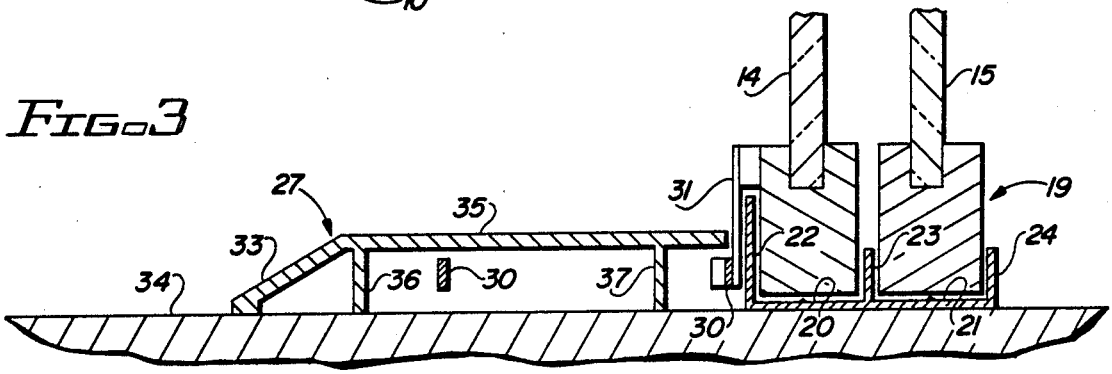
FIG. 5
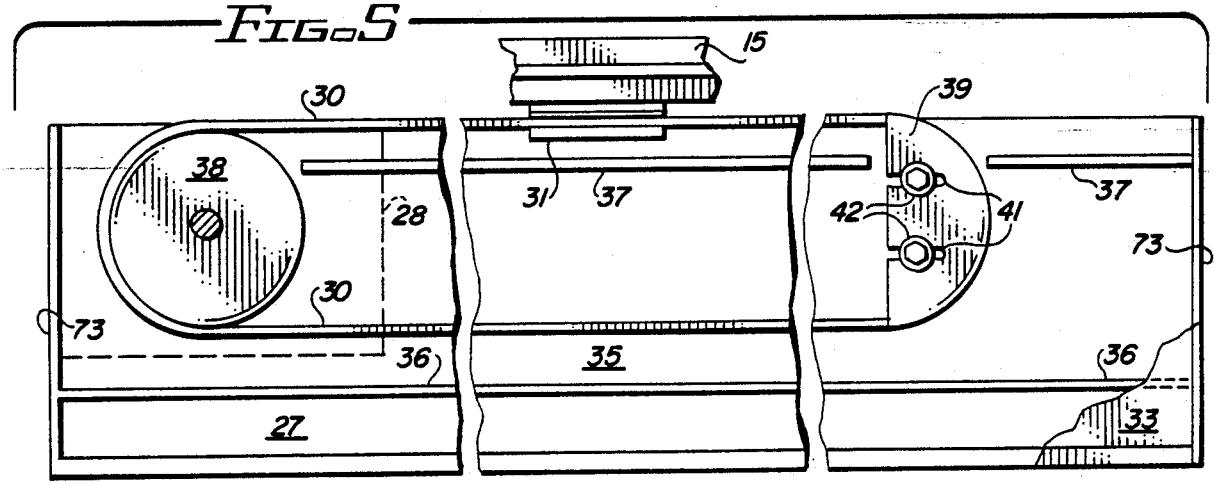

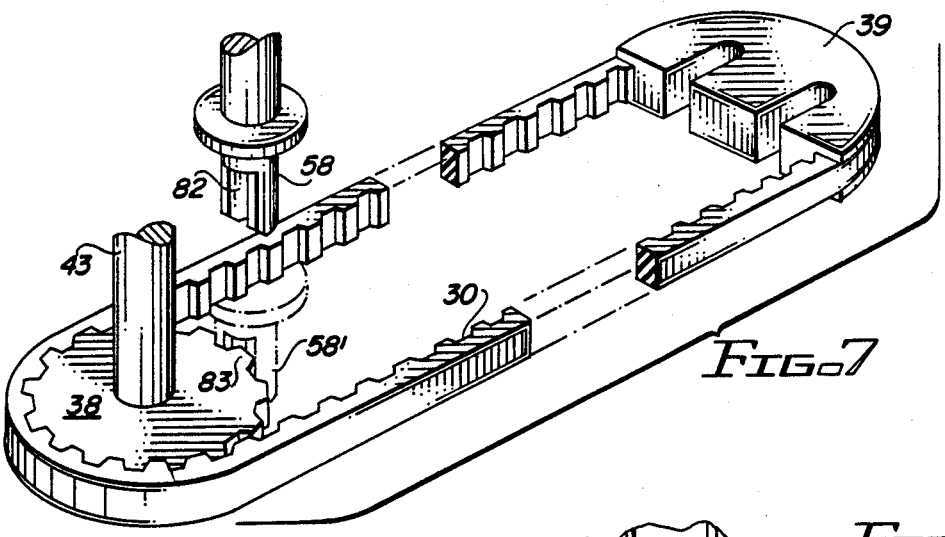
FIG. 7
FIG. 8
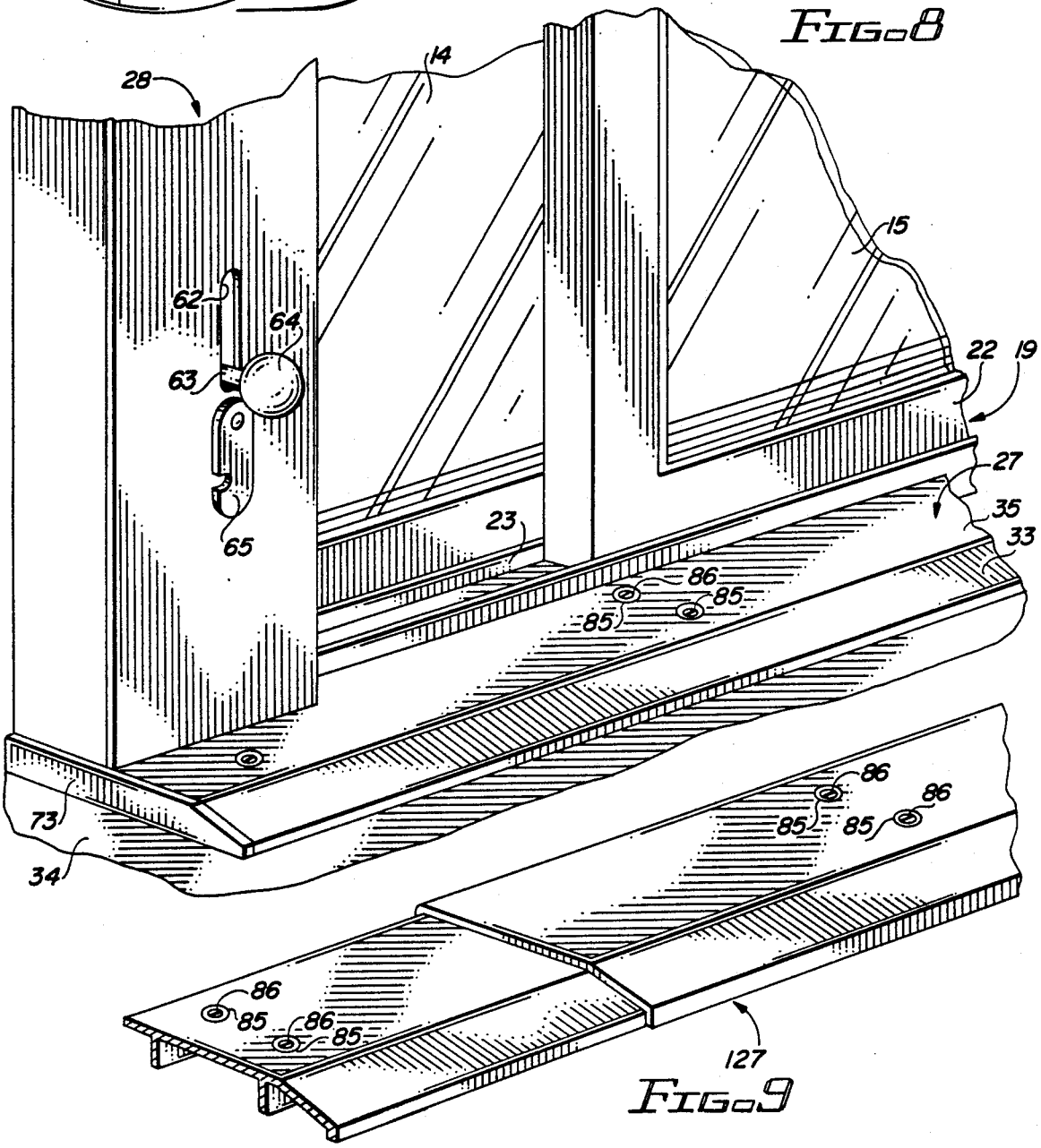
FIG. 9

LOW PROFILE SLIDING DOOR OPENER

This invention relates to an improved opener for doors, windows and the like having adjacently positioned sliding closure panels.

BACKGROUND OF THE INVENTION

An opener of the type to which the present invention relates is shown in Gallis U.S. Pat. No. 3,890,744 wherein a patio door operating unit comprises a housing which mounts on the floor beside a fixed glass door next to a location that an adjacent sliding glass door occupies when the sliding glass door is in its open door position. Within the housing is an endless belt that engages the sliding door adjacent one end and that is driven along a horizontal path by an electric motor located within the housing. Electrical limit switches act to stop the door at its open and closed positions. The housing also includes a solenoid located adjacent the floor and connected to the motor circuit to tighten the belt when electric power is applied and to loosen it so the door can be moved by hand when power is off.

The Gallis device takes the form of a contained unit that can be readily mounted by a professional installer or homeowner-handyman after original installation of the doors. The unit includes an L-shaped bracket that is affixed at its top to the movable door through an opening in the part of the housing immediately adjacent the door and is clamped at its bottom to one run of the belt. Power is supplied to the unit by means of a standard cord that plugs into a nearby 110-volt power supply wall outlet. An operating switch is mounted at any convenient location on the wall adjacent the door opening and is connected to the rest of the circuitry by low voltage wiring.

The Gallis operator has all components, including the electric motor, control box and solenoid elements received within a uniform height, floor-mounted housing. This has several disadvantages. Such an arrangement requires that the housing have a corresponding minimum height to contain the same. This limits the location of the unit to a position, as shown in the '744 patent, that cannot extend very far beyond the fixed door panel. Positioning the same elsewhere would interfere with ingress and egress through the opening. Thus, while the Gallis operator may be suitable for patio door units having one opening and one fixed panel, the same would interfere with normal use of a patio door in which both door panels slide and would be unsuitable for larger openings having a greater number of sliding panels, such as openings in which a distal panel moves against one or more proximate panels to carry the proximate panels with it.

Even in use as an opener for a single sliding door adjacent a single fixed door, as disclosed in the '744 patent, the Gallis unit housing has an unsightly high profile. Gallis suggests that drapes may be hung and closed to conceal the housing; however, concealing the housing also obstructs the view through the fixed panel glass pane and frustrates a major purpose for having a see-through door in the first place.

The Gallis '744 unit is also deficient in that location of electrical elements along the floor in a housing having a slot facing the door exposes the electrical components to water due to rain and ground flooding. This is undesirable, particularly for ground level installations in low lying areas, and may even be impermissible under local electrical codes, particularly in the Southern States.

Moreover, though the opener of Gallis provides positive endless belt driven operation during door opening and closing, no suitable door movement locking mechanism is provided. When the belt-tightening solenoid of the preferred embodiment of the '744 patent is deenergized, the belt is slackened to present no impediment to manual movement of the sliding panel. The suggested alternative arrangement of locking the door by maintaining the power belt taut through continuous solenoid energization not only requires the steady costly application of energy with attendant additional wear on the active components, but is rendered useless whenever an electric power failure occurs. Also, where the solenoid is energized, manual override is impeded.

SUMMARY OF THE INVENTION

It is an object of the present invention to provide an improved automatic opener for one or more closure panels of a sliding panel door, window or the like that has a low, nonintrusive, aesthetically pleasing profile and that can be included at the time of original construction or subsequently added by the professional installer or homeowner-handyman.

It is another object of the present invention to provide an improved automatic opener for the sliding panels of a door, window or the like which may be installed as a unit package at the time of original construction or thereafter in floor-mounted position, however, with all electrical wiring and components elevated above floor level, out of the way of rainwater seepage and other water intrusion.

It is a further object of the present invention to provide an automatic opener for a sliding panel door, window or the like which permits manual override whether or not door circuitry is energized and also has a selectively engageable locking feature that operates independently of the override mechanism.

In accordance with one aspect of the invention, an opener is provided in the form of an endless belt and associated sliding panel moving elements located in a horizontal planar configuration within a low profile, threshold-like housing extending across the bottom on one side of a wall opening covered with a sliding closure panel. Electrical components, including a reversible motor are separately housed in an inconspicuous compact unit at one side of the opening in elevated position above the belt threshold housing. In another aspect of the invention, manually and electrically releasable elements are provided to lock the belt, and thus the door, against movement when desired. The belt is driven by a member through the intermediary of an electrically engaged clutch device which permits manual override of the door opener, whenever the locking mechanism is disengaged.

A preferred embodiment, described in greater detail below, has an electrical motor and electrical clutch mounted in a separate housing along with belt pulley locking elements in a wall cavity or adjacent the wall at one end of a sliding panel opening, with shaft and rod elements oriented in adjacent vertical positions, perpendicular to the plane of the endless belt components.

BRIEF DESCRIPTION OF THE DRAWINGS

FIG. 1 is an elevation view of the interior of a sliding closure panel covered wall opening of a building, showing an embodiment of opener in accordance with the invention mounted at a bottom marginal portion thereof;

Figure 4:
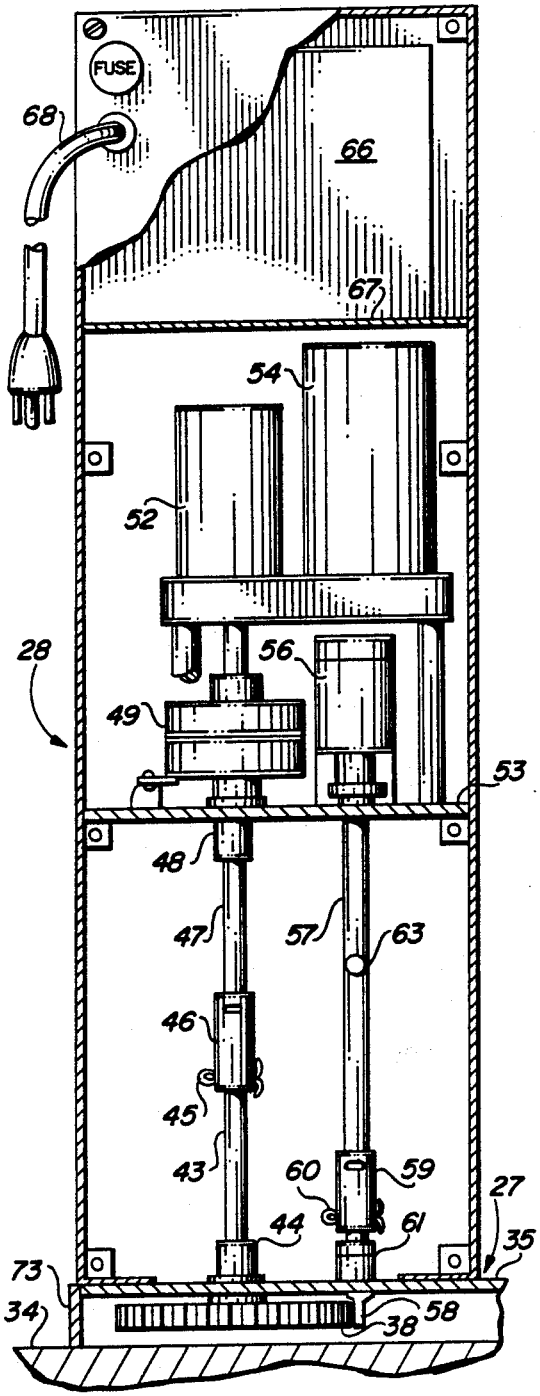
Figure 6:
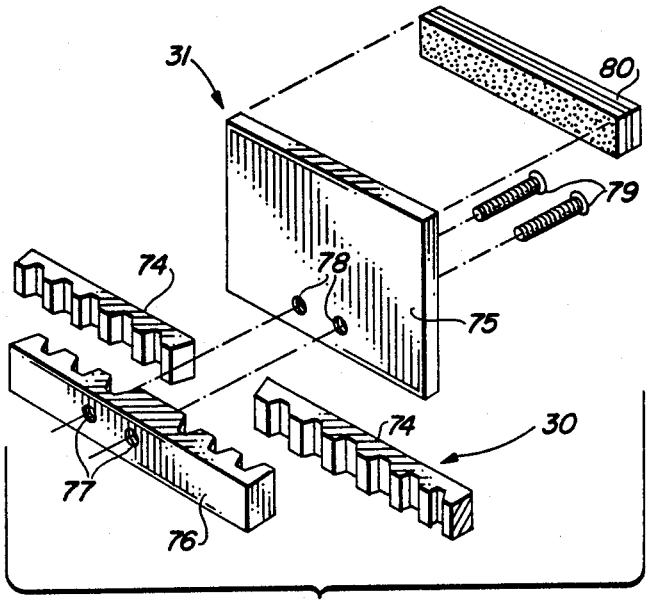

FIG is a top plan view of the opener of FIG. 1 shown from the position of a section line 2—2 taken of the open of FIG. 1;

FIG. 3 is a section view of the embodiment of FIGS. 1 and 2 taken along the line 3—3 of FIG. 2;

FIG 4 is an enlarged, front elevation view, with front portions cut away, of the left side of the embodiment of FIG. 1;

FIG. 5 is a top plan view of the opener of FIG. 1 looking through the threshold as if it were transparent;

FIG. 6 is an exploded view showing the belt-to-door attachment bracket of the opener;

FIG. 7 is a perspective, fragmentary view of the sprocket drive and lock pin elements;

FIG. 8 is a perspective, fragmentary view of a left side portion of the unit, helpful in understand the manual unlocking procedure; and FIG. 9 is a fragmentary view of a modified form of a portion of the unit of FIGS. 1–8.

Throughout the drawings, like elements are referred to by like numerals.

DESCRIPTION OF THE PREFERRED EMBODIMENTS

An exemplary implementation of the invention is given by an embodiment of opener 10 shown generally in FIGS. 1 and 2 mounted on the floor adjacent a bottom marginal portion of the interior of a wall opening 12 in the form of a sliding glass door unit having a rectangular door frame 13 within which left and right door closure panels 14 and 15 are supported for relative lateral sliding movement from adjacent side-by-side closed-door positions (shown in solid lines in FIGS. 1 and 2) to adjacent face-to-face opposing, open-door positions (indicated by dot-dashed lines in FIG. 2.) Such a two-door panel arrangement is well-known and quite common. In a residential home patio door arrangement, for example, doors 14 and 15 may take the form of a sliding glass panel door unit having framework and glass pane doors with panel 14 being a fixed door frame or sash and only panel 15 being movable. The opener of the invention has application to units having a greater number of sliding panels, however, such as openings in which a distal panel moves against one or more proximate panels to carry the proximate panels with it.

The door frame 13 generally comprises a top sill or plate 16, left and right jambs 17, 18, and a bottom sill or plate in the form of a parting strip 19 (see FIG. 3) having inside and outside channels or tracks 20, 21 defined by inside, middle and outside vertical partitions 22, 23, and 24 to respectively receive and confine the lower extents of the panels 14, 15. The doors may be hung by suspension from the top plate 16 and/or provided with rollers or frictional sliding means for support in the bottom runs of the channels 20, 21. The opening 12 may be located in an interior or exterior wall 25.

The unit 10 in accordance with the invention comprises two sections, as shown in FIGS. 1 and 2: a first, low profile, threshold plate-like housing element 27 that extends at floor level across the full width of the door opening 12 and has a uniform height generally equal to or less than the height of the parting strip 19 of the door frame 13 (see FIGS. 3 and 8). As shown, this low profile housing 27 does not obstruct the passage of persons through the opening 12 when the right panel 15 is moved to its door opened position (dot-dashed position 15' shown in FIG. 2). Moreover, in arrangements having both panels 14 and 15 slidable relative to the wall 25, the housing 27 also does not obstruct the part of the opening 12 covered by the left panel 14.

A second housing 28, containing the motor components of the opener 10, is located inconspicuously and unobtrusively at one side of the door opening 12. For the configuration shown in FIGS. 1 and 2, the motor housing 28 is shown in abutment with the left jamb 17. An alternative arrangement (indicated by dot-dashed lines in FIGS. 1 and 2) is to locate the motor housing 28 as indicated at 28' within the cavity of the wall 25 adjacent the jamb 17. The motor housing 28 assumes a generally vertically elongated, narrow width profile adjacent one side of the opening 12 at a lower corner portion thereof, and is attached with its base resting on the top of the threshold plate housing 27.

For the fixed door panel 14 configuration illustrated, in contrast to the patio door operator of Gallis '744 which requires a drape to be closed more than halfway across the opening 12 (viz. completely across panel 14 and partly across panel 15) to conceal the housing, even with the housing 28 in the solid line position shown in FIGS. 1 and 2, the unit 10 is almost totally nonapparent and the housing 28 portion can be totally concealed by the normal hanging of a drape in its open position on the left side of the door. This is aesthetically advantageous, especially where the wall opening 12 forms the entranceway to, for example, the reception area of an office in a multistory office building from which customers and potential customers will gain a first impression by looking from the outside into the sliding glass door unit. The unit according to the invention will not stand out; the Gallis unit will stick out whether or not a drape is present and closed.

As in the Gallis '744 arrangement, the operating element of the illustrated opener 10 in accordance with the present invention is an endless belt 30 (see FIGS. 3–7) attached by means of a bracket 31 (FIG. 6) to the sliding panel door 15 on a lower portion thereof at a height above the inner vertical partition 22 of the inside track 20 of the parting strip 19. Unlike the arrangement in the '744 patent which requires attachment of the bracket at a point on panel 15 which is located immediately adjacent the panel 14 when panel 15 is in its closed door position, the bracket 31 of the present invention can be attached at any point along the inside bottom of the inner movable door 15 above the parting strip 19, and is preferably attached at a point intermediate its left and right extremes. The unit of the present invention will even permit attachment of a plurality of brackets at spaced positions along the bottom of door 15, which may in some cases achieve a smoother operation.

Various configurations are possible for the threshold housing 27 and for mounting the endless belt 30 therein to draw and retract the bracket 31 in translational movement across the opening 12 to move the door 15 from its closed to its open position, and vice versa. A preferred form of threshold housing 27, shown in cross-section in FIG. 3, is an extruded component having a sloped ramp inner portion 33 forming a tapered transition between the floor 34, and having a horizontal top plate portion 35, uniformly elevated above the floor 34 by depending supporting rib elements 36, 37. The elements 36, 37 extend longitudinally at laterally spaced positions for the full length of the housing 27 except for interruptions of the element 37 at locations beyond the extremes of travel of the bracket 31 to accommodate belt retaining members 38, 39 about which the belt is driven (see FIG. 5). The housing 27 is open along its outside edge adjacent the opening 12 and is also open at the bottom.

The members 38, 39 can be pulleys, wheels or similar elements, with one of them driven by motor components located in the motor housing 28. In the preferred embodiment shown the belt retaining member 38 takes the form of a circular sprocket around which the left end of a single loop of a complementary toothed belt is mounted, and member 39 takes the form of an arcuate shoe having a peripheral channel or groove around which the right end of the belt 30 is guided (see FIGS. 5 and 7). The belt 30, sprocket 38 and shoe 39 are arranged so that the loop of the belt 30 has two laterally spaced, longitudinally extending runs placed parallel with the inside faces of the panels 14 and 15. As shown in FIG. 5, the bracket 31 is attached to the outside longitudinal run of belt 30 which is suspended between the rib 37 and the partition 22; the inside longitudinal run is suspended between the ribs 36 and 37.

In the illustrated arrangement of housing 27, the shoe 39 is attached to the underside of the top plate portion 35 (see FIG. 5) at a position to the right of the furthest extent of right-hand travel needed for the bracket 31 to close the door 15, i.e. to the right of the point of attachment of the bracket 31 to the panel 15 when the panel 15 is in its closed position. The shoe 39 is preferably of semi-circular configuration with elongated slots 41 aligned longitudinally with the housing 27 through which fasteners 42 are brought for fixing the position of the member 39 relative to the housing 27. The elongation of the slots 41 permits adjustment of the tension of the belt 30.

The sprocket 38 (see FIG. 4) is formed with a central, upwardly extending shaft 43 that passes by means of a bushing 44 through an opening adjacent the left end of the top plate portion 35 of the threshold plate housing 27 and upwardly into the housing 28 located thereabove. The upper end of the shaft 43 has a bore (not visible in FIG. 4) through which a cotter pin or similar element 45 may be passed for retaining the shaft 43 in position by means of a coupling 46 at the lower end of an elongated, vertically extending drive shaft 47 which extends through a bushing 48 from the opposite end of a torque limiting, normally disengaged electronic clutch assembly 49. The input end of the clutch assembly 49 is connected to the output shaft of a reversible electric motor 52. The clutch 49, motor 52 and associated components are mounted within the housing 28 by conventional attachment means to a horizontally extending divider plate 53 (FIG. 4). A capacitor 54 is mounted adjacent the motor 52. The elevation of the divider plate 53 and length of the shaft 47 are chosen to meet the shaft 43 of the sprocket 38 positioned within the threshold housing 27 at an appropriate elevation above floor 34 and below the top of the strip 19.

An electrical solenoid assembly 56 is also mounted on the divider 53 adjacent the clutch 49 with an armature shaft 57 depending therefrom in vertical, longitudinal alignment with the elongation of the housing 28. A lock pin 58 is mounted by means of a coupling 59 and fastener 60 to the lower extreme of the armature shaft 57. The pin 58 passes through a bushing 61 into the threshold housing 27, so that when the armature shaft 57 is lowered into its downmost solenoid deenergized position (shown by solid lines in FIG. 4 and by dot-dashed lines 58' in FIG.7), the pin 58 moves into a sprocket rotation blocking position peripherally of the sprocket 38. The armature 57, pin 58 and associated components are dimensioned, configured and adapted so that the pin 58 will be withdrawn from its sprocket movement blocking position (into the solid line position of FIG. 7) upon energization of the armature 56. The front of the housing 28 is provided with an elongated slot 62 through which a cross member 63 with a plastic knob 64 extends to provide manual release capability to the lock pin 58 (see FIG. 8).

The solenoid 56 functions to lift the lock pin 58 into its unblocking (FIG. 7 solid line) position whenever the motor 52 is energized for driving the belt 30 to open or close the door 15. The pin 58 is otherwise dropped down to a blocking (FIG. 7 dot-dashed line) position by gravitational force to prevent opening the door. The pin 58 may also be raised manually by grasping the knob 64 (FIG. 8)and moving the cross member 63 up within the channel 62 in order to permit manual opening and closing the door 15 when the motor 52 is off, the clutch 49 being normally disengaged when the motor 52 is inactive. A latch 65 (FIG. 8) is pivotally mounted adjacent the channel 62 on the front of the housing 28 to provide a way to maintain the lock pin 58 in its sprocket unblocking position. The latch 65 may be pivoted over the channel 62 until a semicircular cutout on one side of the latch 65 engages the member 63 circumferentially, thereby holding it up.

Control circuitry for the unit 10 is constructed in accordance with known principles and may be located in a control box 66 (FIG. 4) separated by a second horizontal divider plate 67 within the housing 28 at a location above the motor 52 and related drive and lock elements discussed above. Power for the control of the motor 52 and solenoid 56 can be fed to the unit 10 by means of a standard cord 68 which can be plugged into a conveniently located standard electrical wall outlet 69 (FIG. 1). Alternatively, and especially for the wall cavity installation 28' indicated by dot and dashed lines in FIGS. 1 and 2, the unit 10 can be wired directly into the building electrical wiring, as by tapping into the wiring at the outlet box 69.

A wall-mounted switch 70 (FIG. 1) may be mounted on the wall 25 adjacent the door opening 12 for control of the operation of the door. The switch 70 may be connected to the rest of the circuitry by low voltage wiring or may preferably be coupled thereto in a wireless manner in accordance with well-known techniques. The embodiment of switch 70 shown takes the form of a toggle switch having a wide area toggle element with upper and lower portions 71, 72 that correspond, respectively, to "door open" and "door close" switch connections and are configured, dimensioned and adapted to allow elbow manipulation thereof. Other options (not shown) may include providing a separate adjacent switch element having similar toggle areas to surfaces 71, 72 of switch 70, wired to provide "door lock" and "door unlock" positions respectively corresponding to deenergization and energization of the solenoid 56 for lowering or raising the lock pin 58. Other possibilities include the provision of a mechanism for remote operation of the unit 10 by means of a hand-held wireless control, similar to that available for garage doors, televisions and similar electrical applicances. Such provision can be made in accordance with well-known techniques and provides an advantage that opening and closing can be accomplished from the exterior, as well as the interior of the door opening 12. Other options include the provision of a mechanical or electrical key or combination locking mechanism for the switch 70 to prevent unauthorized use.

In operation, the switch 70 is toggled by pressing its "door open" position surface 71, thereby actuating circuitry 66 to energize the solenoid 56 for drawing the normally descended lock pin 58 upwards with the armature shaft 57 to unblock the sprocket 38. The same operation energizes the reversible motor 52 to engage the clutch 49 to drive the coupled shafts 47, 43 in a direction of rotation which rotates sprocket 38 to move the belt 30 to carry the bracket 31 attached to door 15 towards the left. The door will continue to move to the left as long as the toggle area 71 of the switch 70 remains depressed, or until the door reaches its leftmost limit of movement. In the latter case, further rotation of the sprocket 38 will cease when the torque exceeds the limit of the clutch 49. To close the door 15 again, the other area 72 of the toggle switch 70 is depressed to move the motor 52 in the opposite direction, driving the belt 30 to move the bracket 31 to the right until either the switch 70 is released or the door reaches the right jamb 18. It is not considered necessary to provide limit switches at the extremes of travel to automatically turn off the motor 52; although this can be done if desired. The toggle switch 70 is, instead, spring-loaded to a neutral, motor-deenergized position, so that it operates in a "deadman-release" fashion, to deactivate the motor whenever the switch 70 is let go. The engaged clutch 49 is a torque limiting device that slips when the limits of travel are reached to protect the motor until the switch 70 is released.

The clutch 49 also releases the sprocket 38 for free rotation with the belt 30, whenever the motor is deenergized and the pin 58 is raised to its unblocking position This permits manual operation of the door when the pin 58 is raised, without adverse effect on the unit 10. The clutch (49) also slips to interrupt movement of the door should an obstruction, such as a person's hand, chair leg, etc., become located in the door's path of movement. When the switch 70 is not engaged, release of the lock pin 58 may be accomplished by raising the armature shaft 7 manually by gripping the knob 64 (FIG. 8) and lifting the cross member 63 within the channel 62. The pin 58 can be maintained in its raised position by swinging the latch 65 around to capture the member 63 in its upward position.

It is noted that the tiered arrangement of components within housing 28 (see FIG. 4) places the water sensitive electrical components at the highest elevations of the unit 10 above the floor 34. The depicted arrangement has no electrical components whatsoever at floor level within the threshold housing 27. Such is not the case with the prior art operator shown in Gallis U.S. Pat. No. 3,890,744. Furthermore, by providing only the belt 30, bracket 31 and belt retaining members 38, 39 adjacent the floor 34, the same may be accommodated within a very low profile, aesthetically pleasing threshold element 27 of simple construction. It is noted that (except for the .interconnection between housings 27 and 28 and the bushings 44 and 61 only the shoe 39 is connected to the threshold housing 27 and that such connection is readily made in simple manner to the underside of the top plate portion 35. Thus, the threshold 27 does not require a bottom plate and can be left open both at its inside edge (i.e. the edge adjacent the vertical partition 22 along which bracket 31 moves) and at its base (i.e. the part facing the floor). This is not the case for the operator in the '744 patent. The open left and right ends of the threshold housing 27 are each closed with a plate-like end cap 73 (see FIG. 8).

The bracket 31 may have a segmented structure as shown in FIG. 6, with the lower end functioning to draw free ends of the belt 30 together to form the loop. Alternatively, of course, a belt 30 having a preformed closed loop may be used. As shown in FIG. 6, belt ends 74 are positioned between a vertical plate 75 and a keeper 76 which is notched to match the teeth of the belt 30 and includes threaded bores 77 which align with bores 78 adjacent the bottom of plate 75 so that it can be attached thereto by fasteners 79. The top of the plate 75 includes means, such as a hook and loop Velcro TM-type mating fastener element 80 having pressure sensitive adhesive on both sides, for attaching the top of plate 75 onto a chosen position intermediate the right and left sides of the door 15.

Details of the lock pin 58 engagement with the sprocket 38 are shown in FIG. 7. The pin 58 has an opening 82 into which a nearest sprocket tooth 83 will be guided when the pin 58 descends to its locking position 58' indicated by dot-dashed lines. This locking arrangement is, of course, only one suggested means of providing locking and those skilled in the art to which the invention relates will appreciate that other ways of locking the belt 30 or door 15 are also available. The illustrated type of locking means has the advantage that it is simple in operation, has no electrical parts presented within the threshold housing 27, and provides for a convenient manually operable override by merely maneuvering the knob 64 (FIG. 8) to raise the armature shaft 57 (FIG. 4). It will be noted that this is superior to the locking means described in the Gallis patent which requires continuous energization of a solenoid.

An exemplary implementation of the opener 10 in accordance with the above description has a threshold of 5" depth (dimension normal to the planes of the door panels 14, 15) and ¾" height (vertical dimension) of aluminum extrusion, cut to a length sufficient to extend along the floor 34 across the entire width of the door opening 12 from left to right sides. The motor housing 28 has a width (dimension parallel to the length of the threshold housing 27) of 5" and a depth of 2½, with a height of 16" or smaller depending on the size of motor, etc. A height of 16" has been found suitable for raising the electronic components sufficiently high off the floor to avoid moisture or water problems for ground floor installations of the opener 10.

The toothed or ribbed belt 30 may be a ¼ wide belt with teeth spaced 2/10" apart, the teeth having opposite angled sides converging at an angle of approximately 50°. The belt 30 may be a vulcanized rubber or other industrial belt material, such as Berg 37 TB belting. The vertical plate 75 of the bracket 31 may be approximately 1½" high, 2" wide and 1/6" thick. The keeper 76 has a width to match the plate 75, a ¼" height and a ¼" depth. The sprocket assembly can comprise a sprocket 38 of 48-tooth, 0.2" pitch molded plastic of ¼" width and 3" diameter. The shaft 43 can be a 3" length, ¼" diameter aluminum shaft secured to the sprocket 38. The shoe 39 may be a plastic semi-circular element having a 0.275" width arcuate groove peripherally thereof and a total thickness of ½".

For a total belt of 11" nominal length and shoe-to-sprocket spacing of approximately 70", attachment of the bracket 31 can be made at any point intermediate the left and right sides of a door 15 of a 6' two-door panel opening 12. The same unit 10 can be accommodated to similar 8′ and 10′ openings by merely adjusting the length of the threshold plate 27 on the right-hand side. Accordingly, it is possible to provide an extra-long threshold housing 27 that can be cut to length at installation. Alternatively, a telescoping unit can be used, as shown in FIG. 9, to provide a lengthwise variable threshold 127 to match various widths of door openings 12 with a single unit. Attachment of the threshold housing 27 to the floor 34 can be made in conventional manner as with usual door threshold plates by providing countersunk bores 85 at periodic intervals along the top plate portion 35 of the member 27, through which fasteners 86 may be driven into the floor.

It will be appreciated by those skilled in the art to which the invention relates that the foregoing detailed description is intended to be merely exemplary and not exhaustive and that various other substitutions and modifications may be made to the described embodiments without departing from the spirit and scope of the invention as defined by the claims below.

I claim:

1. An opener for a closure panel movably mounted to slide along an elongated channel strip across a bottom of a wall opening between "panel closed" and "panel open" positions, said opener comprising:

a housing member in the form of a threshold plate dimensioned, configured and adapted to extend nonintrusively across said bottom of said opening adjacent said channel strip;

a belt;

means for mounting said belt within said housing member for movement along a run longitudinally aligned with said channel strip;

means for attaching said panel to said belt at said run for movement therewith;

a motor; and means mounting said motor at an elevation above said threshold plate for driving said belt mounting means by said motor to move said belt along said run to move said attached panel between said positions.

2. An opener as in claim 1, further comprising a locking element mounted for movement within said threshold plate between panel movement blocking and unblocking positions; and means located above said threshold plate for selectively moving said locking element between said blocking and unblocking positions.

3. An opener as in claim 2, wherein said belt mounting means comprises a rotatable wheel, and said locking element comprises means movable into and out of engagement with said wheel.

4. An opener as in claim 2, wherein said means located above said threshold plate includes a solenoid having an armature; and said locking element comprises a lock pin coupled to said armature and extending into said threshold plate, said armature cooperating with said pin to raise said pin when said solenoid is energized and to lower said pin when said solenoid is deenergized.

5. An opener as in claim 4, further including means for manually moving said pin into its unblocking position when said solenoid is deenergized.

6. An opener as in claim 5, further including means for maintaining said pin in said unblocking position independent of energization or deenergization of said solenoid.

7. An opener as in claim 1, wherein said means mounting said belt comprises a rotating member located within said threshold plate, means mounting said belt in an endless loop about said rotating member, and a shaft extending upwardly from said rotating member and connecting to said motor.

8. An opener as in claim 7, wherein said means mounting said belt further comprises a guide member attached to said threshold plate at a longitudinally spaced position from said rotating member, said loop being elongated and extending at one end about said rotating member and at an opposite end about said guide member.

9. An opener as in claim 8, wherein said belt is a toothed belt, and wherein said rotating member is a toothed sprocket.

10. An opener as in claim 9, wherein said guide member comprises a shoe fixed to said threshold plate at a top plate portion thereof and having a recessed arcuate channel within which said belt is located.

11. An opener as in claim 7, further comprising an electrical clutch connecting said shaft to said motor.

12. An opener for a glass door panel movably mounted to slide along an elongated channel strip across a floor of a wall opening between "door closed" and "door open" positions, said channel strip having a height and said opener comprising:

a first housing member in the form of a threshold plate extending across said floor of said opening adjacent said channel strip and having a height no greater than said height of said channel strip;

a belt;

means, including a rotating member, mounting said belt in a generally planar endless loop within said first housing member for movement of said belt along a run longitudinally aligned with said channel strip;

means attaching said panel to said belt at said run for movement therewith;

a second housing member positioned above said first housing member marginally of said opening;

a motor mounted in said second housing member; and means extending between said first and second housing members for driving said rotating member by said motor to move said belt along said run to move said panel between said positions.

13. An opener as in claim 12, wherein said means mounting said belt further comprises a shaft suspending said circular member in said first housing member and extending upwardly from said first housing member to said second housing member and connecting said rotating member to said motor.

14. An opener as in claim 13, wherein said belt comprises a toothed belt, and said rotating member comprises a toothed sprocket mating with said toothed belt.

15. An opener as in claim 14, further comprising a member operable to release said shaft from being driven by said motor when torque exerted by said motor on said sprocket exceeds a preset amount.

16. An opener as in claim 14, further comprising a locking element mounted for movement within said first housing member between panel movement blocking and unblocking positions; and means located in said second housing member for selectively moving said locking element between said blocking and unblocking positions.

17. An opener as in claim 16, wherein said locking element is a pin, and said locking element moving means comprises a solenoid having an armature rod coupled to be raised and lowered when said solenoid is energized and deenergized to move said pin between positions respectively blocking and unblocking movement of said sprocket teeth; and further comprising electrical circuitry located in said second housing member and connecting said solenoid to be energized whenever said motor is activated to move said panel.

18. An opener as in claim 17, further comprising said second housing member having a slot, and a cross member attached through said slot to said armature rod for manually raising and lowering said armature rod to move said pin between said blocking and unblocking positions independently of the energization state of said solenoid.

19. An opener as in claim 18, further comprising a latch, and means attaching said latch to said second housing member adjacent said slot, for selective movement of said latch into and out of a position to lock said cross member for maintaining said pin in its unblocking position.

20. In combination with a wall opening having a frame, including a channel strip extending across a bottom of said opening, and two glass pane closure panels mounted to said frame, at least one of said panels being mounted to slide along said channel strip between "panel closed" and "panel open" positions, said channel strip comprising an elongated track having inside and outside vertically extending partitions oppositely disposed relative to said at least one panel, an opener comprising:

a first housing member in the form of a threshold plate extending across said bottom of said opening adjacent said track and having a height less than or equal to the vertical extent of said inside partitions;

means, including a normally locked rotating member, mounting said belt in a generally planar endless loop within said first housing member for movement of said belt along a run adjacent to and longitudinally aligned with said inside partition;

means attaching said at least one panel to said belt at said run for movement therewith;

a second housing member positioned above said first housing member, marginally of said opening;

a motor mounted in said second housing member;

means extending between said first and second housing members for driving said rotating member by said motor, when said rotating member is unlocked, to move said belt along said run to move said panel between said positions;

a solenoid mounted in said second housing member; and means extending between said first and said second housing members for selectively unlocking said rotating member by said solenoid when said motor is engaged.

* * * * *